US009120110B2

(12) United States Patent
Huffman

(10) Patent No.: US 9,120,110 B2
(45) Date of Patent: Sep. 1, 2015

(54) LIQUID SPRAY DISPENSER SUCTION TUBE DEFLECTOR

(71) Applicant: Scott Huffman, Parker, CO (US)

(72) Inventor: Scott Huffman, Parker, CO (US)

( * ) Notice: Subject to any disclaimer, the term of this patent is extended or adjusted under 35 U.S.C. 154(b) by 0 days.

(21) Appl. No.: 14/298,478

(22) Filed: Jun. 6, 2014

(65) Prior Publication Data

US 2014/0284300 A1 Sep. 25, 2014

Related U.S. Application Data

(63) Continuation of application No. 13/342,600, filed on Jan. 3, 2012, now Pat. No. 8,789,728.

(51) Int. Cl.
*B05B 11/00* (2006.01)
*B05B 15/00* (2006.01)

(52) U.S. Cl.
CPC ..... *B05B 11/0089* (2013.01); *B05B 11/0008* (2013.01); *B05B 15/005* (2013.01); *B05B 11/3011* (2013.01); *Y10T 29/49817* (2015.01); *Y10T 29/49826* (2015.01)

(58) Field of Classification Search
CPC ..... B05B 11/0037; B05B 11/3057; B05B 11/0059; B05B 11/3011; B05B 15/005
USPC ..... 222/383.1, 382, 464.3, 464.5, 383.3, 222/372, 192, 377, 464.7, 464.1; 239/333
See application file for complete search history.

(56) References Cited

U.S. PATENT DOCUMENTS

| | | | | |
|---|---|---|---|---|
| 5,657,910 | A * | 8/1997 | Keyser | 222/382 |
| 7,118,012 | B2 * | 10/2006 | Butler | 222/129 |
| 7,793,801 | B2 * | 9/2010 | Drummond | 222/179 |
| 2006/0016910 | A1 * | 1/2006 | Engelen et al. | 239/302 |

* cited by examiner

*Primary Examiner* — Paul R Durand
*Assistant Examiner* — Charles P Cheyney
(74) *Attorney, Agent, or Firm* — Neugeboren O'Dowd PC

(57) ABSTRACT

Systems, methods, and apparatus for deflecting an angle of a flexible suction tube of a spray dispenser (or bottle). In particular, an insert can be located between a cap and a neck of the spray dispenser to deflect, at an angle, the flexible suction tube makes as it descends into a body of the spray dispenser. The angle can be such that the flexible suction tube is directed toward an off-center portion of the bottom of the spray dispenser or to a bottom corner or rim of the spray dispenser. As such, the spray dispenser, as modified by the insert, can siphon the last remnants of liquid in the dispenser, which are often not accessible via traditional spray dispensers (e.g., when used in a tilted fashion) where the flexible suction tube is directed toward a bottom center of the dispenser.

16 Claims, 10 Drawing Sheets

LIQUID SPRAY DISPENSER SUCTION TUBE DEFLECTOR

This application claims the benefit of U.S. patent application Ser. No. 13/342,600 filed on Jan. 3, 2012, the details of which are incorporated by reference into the present application in their entirety.

FIELD OF THE DISCLOSURE

The present disclosure relates generally to liquid spray dispensers. In particular, but not by way of limitation, the present disclosure relates to systems, methods and apparatuses for causing a deflection angle to the flexible suction tube of a liquid spray dispenser.

BACKGROUND

Spray bottles used to dispense common liquids in a spray are often used at an angle and therefore are notoriously difficult to empty via the built-in flexible suction tube since the suction tube typically is aligned with a bottom center of the bottle, and not the bottom rim, where the last vestiges of liquid often reside. Traditional spray bottles thus lead to waste as they tend not to make it possible to use the spray mechanism to empty the bottle. Rather the last ounces of liquid are either used by opening the cap and dumping the liquid out, or the last ounces are merely thrown away with the bottle.

Numerous solutions have been proposed that involve causing a deflection of the flexible suction tube via one or more elements built into the bottle. For instance, U.S. Pat. No. 7,055,722 ("Ouellete"), discloses a spray bottle having one or more walls or partitions for directing a flexible suction tube into a chamber of the bottle where fluid preferably is contained even as the bottle is emptied and tipped at various angles. U.S. Patent Publication No. 2505/0087568 ("Silvaggio"), discloses a spray bottle having a first baffle positioned in the bottle to create a well or accumulation of fluid in a bottom portion of the bottle when it is moved from a vertical to a horizontal position, especially when the total level of fluid in the reservoir is low. U.S. Pat. No. 5,464,129 ("Ho") teaches a structure within a spray bottle for completely removing all the liquid from within the container through the dip tube and out of the pump head. Ho uses a dip tube coupled to a first side wall of the bottle via a dip tube maintaining component. However, these inventions can only be used by bottle manufacturers, and users of spray bottles that do not have such built-in deflection angles, are without relief from the problem of emptying a spray bottle.

SUMMARY OF THE DISCLOSURE

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention.

One embodiment of the disclosure may be characterized as a bottle insert for coupling with a spray dispenser. The apparatus includes a coupling portion configured to couple to a cap or neck of the spray dispenser, and the coupling portion can prevent substantial movement of the apparatus relative to the spray dispenser. The apparatus also includes a guide portion attached to a bottom of the coupling portion and configured to descend into a body of the spray dispenser. The guide portion can be shaped to deflect, at an angle, a flexible suction tube of the cap towards an off-center of a bottom of the body of the spray dispenser.

Another embodiment of the disclosure may be characterized as a method including the steps of removing a cap from a body of a spray dispenser, locating an annular insert coaxially and flush with an inner surface of a neck of the body, and threading a flexible suction tube of the cap through the annular insert. A guide portion of the annular insert can deflect the flexible suction tube at a deflection angle where the deflection angle is measured relative to a vertical axis of the spray dispenser. The method can also include attaching the cap to the body thereby causing an end of the flexible suction tube to be positioned near an off-center location at a bottom of the body of the spray dispenser.

Another embodiment of the disclosure may also be characterized as an insert including a coupling portion and a guide portion, where the coupling portion has a midsection and a flange. The midsection is configured to couple to a cap and/or neck of the spray dispenser, and the midsection can prevent substantial pivoting of the apparatus relative to the spray dispenser. The flange extends radially from a top of the midsection and is configured to couple to the cap and/or neck of the spray dispenser. The flange can further prevent substantial vertical movement of the apparatus relative to the spray dispenser. The guide portion is coupled to a bottom of the midsection and configured to descend into a body of the spray dispenser. The guide portion is shaped to deflect a flexible suction tube of the cap, at an angle, towards an off-center portion of a bottom of the body of the spray dispenser.

Another embodiment of the disclosure may be characterized as an insert comprising a coupling portion and a guide portion. The coupling portion can be configured to couple to a cap and/or neck of a spray dispenser. The coupling portion can have an upper portion and a lower portion that are not concentric to each other. Only one of the upper and lower portion at a time may be configured to be concentrically arranged relative to the cap or neck of the spray dispenser. The coupling portion can prevent substantial pivoting of the apparatus relative to the spray dispenser, where such rotation is relative to a horizontal axis. The guide portion can be coupled the lower portion and can be configured to descend into a body of the spray dispenser. The guide portion can be shaped so as to deflect, at an angle, a flexible suction tube of the cap towards an off-center portion of a bottom of the body of the spray dispenser

BRIEF DESCRIPTION OF THE DRAWINGS

Various objects and advantages and a more complete understanding of the present invention are apparent and more readily appreciated by referring to the following detailed description taken in conjunction with the accompanying drawings.

DETAILED DESCRIPTION

Figure 1:
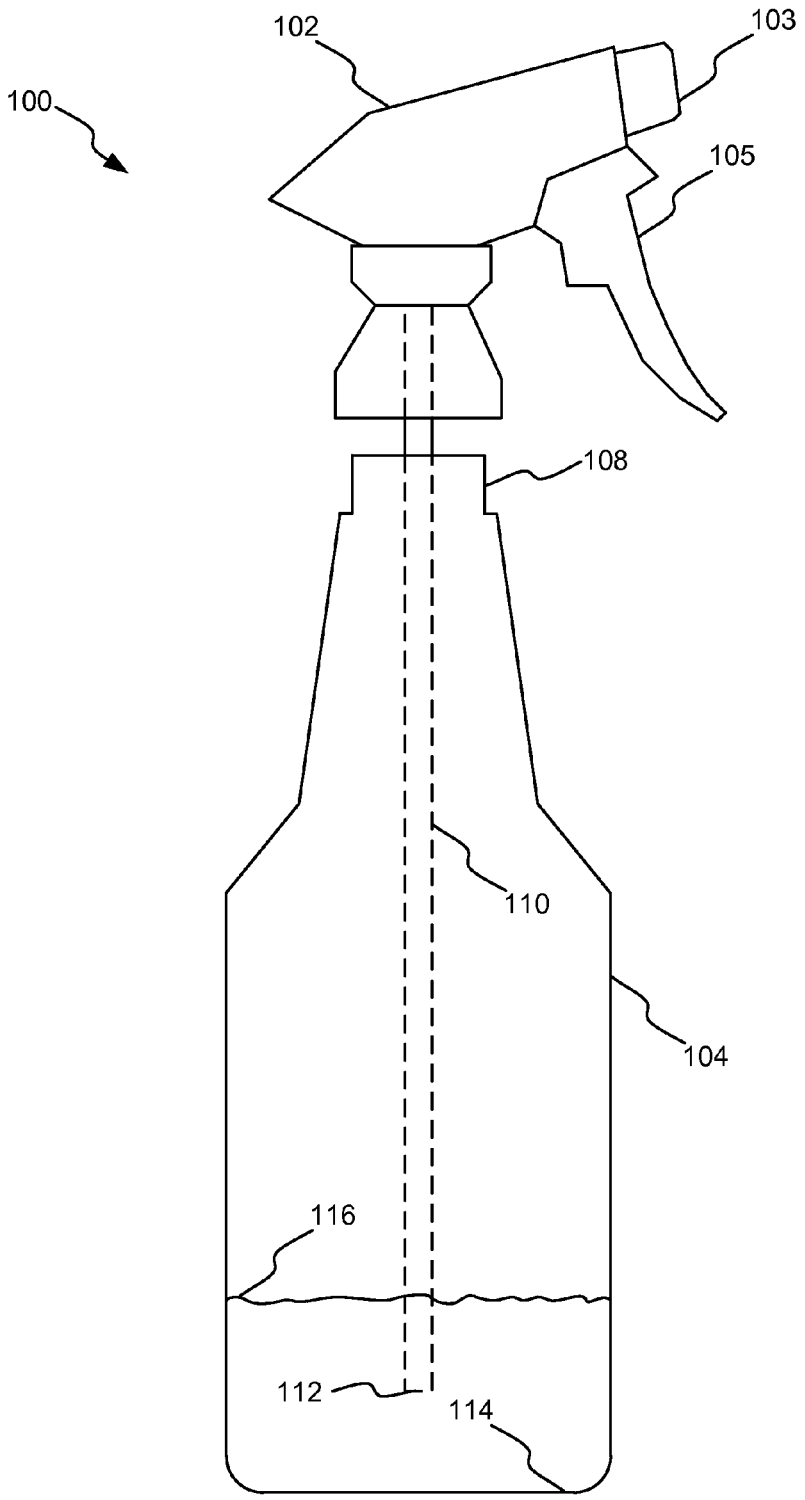
FIG. 1 illustrates a traditional spray dispenser including a cap and a body.

FIG. 1 illustrates a traditional spray dispenser 100 including a cap 102 and a body 104. The cap 102 couples to the body 104 via a neck 108 of the body 104. This coupling can be made via threads of the cap 102 and the neck 108, via a friction fit, via a snap connection, or any other means of coupling two components so as to make a water-resistant or water proof seal, as are well known to those of skill in the art. A flexible suction tube 110 can couple to or through the cap 102 to deliver liquid from the body 104 to a nozzle 103 of the spray dispenser 100 when a trigger 105 or other activation mechanism is depressed. The flexible suction tube 110 descends into the body 104 when the cap 102 and body 104 couple to each other.

The flexible suction tube 110 is typically disposed so that an end 112 is adjacent to or aligned with a center of a bottom 114 of the spray dispenser 100, and operates most effectively when the end 112 is submerged below a liquid level 116 of the dispenser 100. As such, when a level of liquid in the dispenser is low, the end 112 of the flexible suction tube 110 may not be submerged below the liquid level 116 and thus the flexible suction tube 110 may not be able to siphon liquid out of the body 104. When the spray dispenser 100 is tipped at any angle the problem can be amplified since the liquid tends to congregate away from the center of the bottom 114 of the body 104, for instance in a bottom corner of the dispenser 100. These components do not characterize all spray dispensers known in the art, but do reflect a large number of known spray dispensers.

Figure 2:
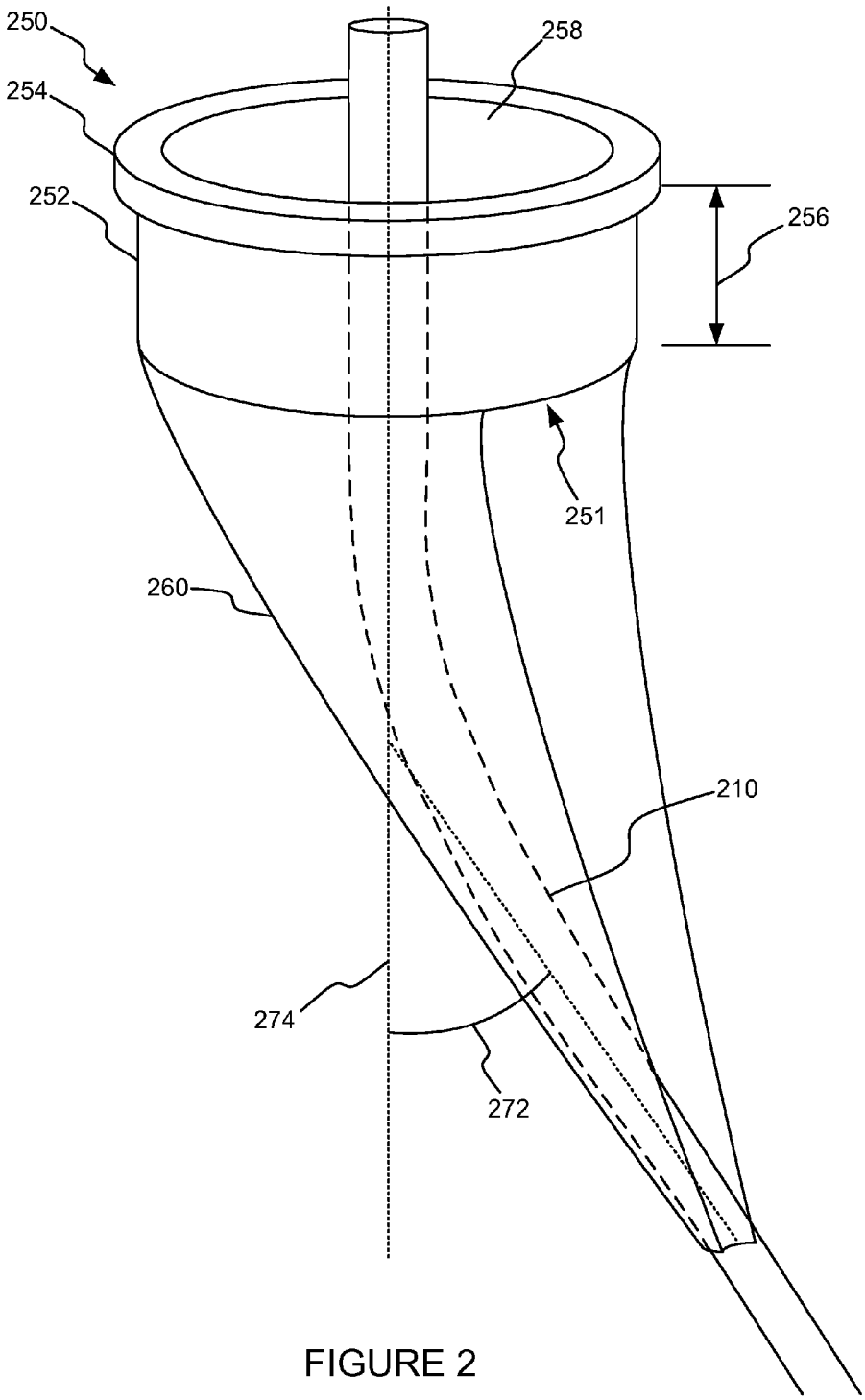
FIG. 2 illustrates an insert for use with a traditional spray dispenser.

FIG. 2 illustrates an insert 250 for use with a traditional spray dispenser such as spray dispenser 100 illustrated in FIG. 1. The insert 250 can be configured to redirect a portion of a flexible suction tube 210 of the spray dispenser (e.g., 100) toward a bottom corner of the spray dispenser. The insert 250 is separate from the dispenser 100, can be purchased separately from the dispenser 100, and can be temporarily coupled to the dispenser 100. The insert 250 includes a coupling portion 251 that can include a midsection 252, a flange 254, and a mouth 258. The coupling portion 251 can be annular. The coupling portion 251 couples to the spray dispenser and can keep the insert 250 in position (relative to vertical and lateral movement as well as rotation). The midsection 252 can have a height 256 ranging from 8-20 mm, or 18-20 mm. In a particular embodiment, the midsection 252 can have a height 256 of 7-10 mm or 9 mm. In another embodiment, the midsection 252 can have a height of 5-20 mm.

A bottom of the coupling portion 251 is coupled to a top portion of a guide portion 260, which is configured to deflect a direction of the flexible suction tube 210 at a deflection angle 272 from a vertical axis 274 of the spray dispenser. At the deflection angle 272, the end of the flexible suction tube 210 is directed towards a non-center of a bottom of the dispenser (e.g., a bottom corner of the dispenser or a bottom rim of the dispenser).

Figure 3:
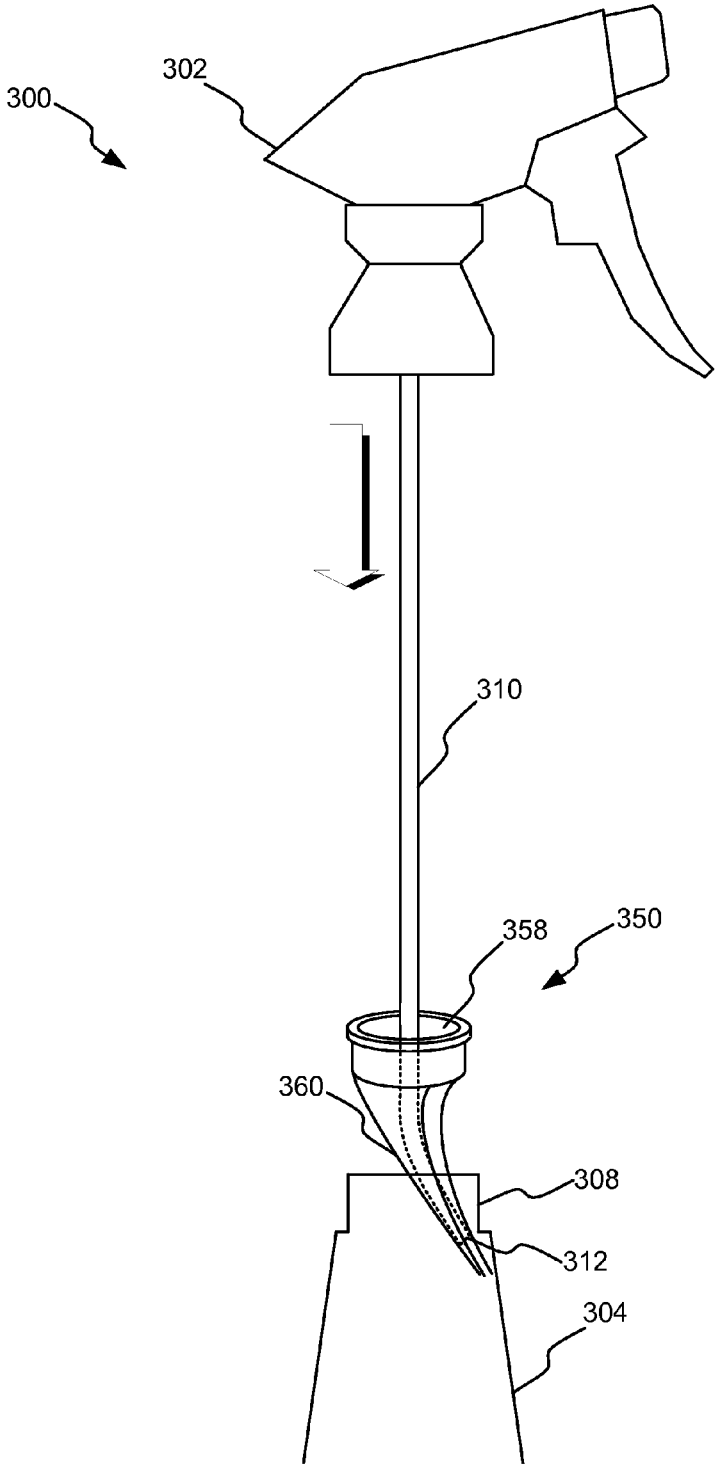
FIG. 3 illustrates one configuration of an insert used in combination with a traditional spray dispenser.

FIG. 3 illustrates one configuration of an insert 350 used in combination with a traditional spray dispenser 300. The cap 302 can be separated from the body 304 and the flexible suction tube 310 can be threaded or inserted through the mouth 358 of the insert 350. The flexible suction tube 310 can then be lowered through the mouth 358 causing the end 312 of the flexible suction tube 310 to contact an inner surface of the guide portion 360 and bend or deflect at a deflection angle dictated by the shape of the guide portion 360. As the cap 302 and insert 350 are brought together, the flexible suction tube 310 is moved further and further through the insert 350. Before, after, or while the flexible suction tube 310 is passed through the insert 350, the insert 350 can be arranged within the neck 308 of the body 304 (see FIG. 4). The cap 302, insert 350, and body 304 can be pressed together and the cap 302 can be coupled to the body 304 as would be done were the insert 350 not present. In other words, the insert 350 is shaped and positioned so as not to interfere with coupling between the cap 302 and the body 304. Once coupled, the flexible suction tube 310 is directed toward a bottom corner of the body 304 rather than toward a bottom center of the dispenser 304. Other than the modified direction of the flexible suction tube 310, the spray dispenser 300 operates as it otherwise would.

Figure 4:
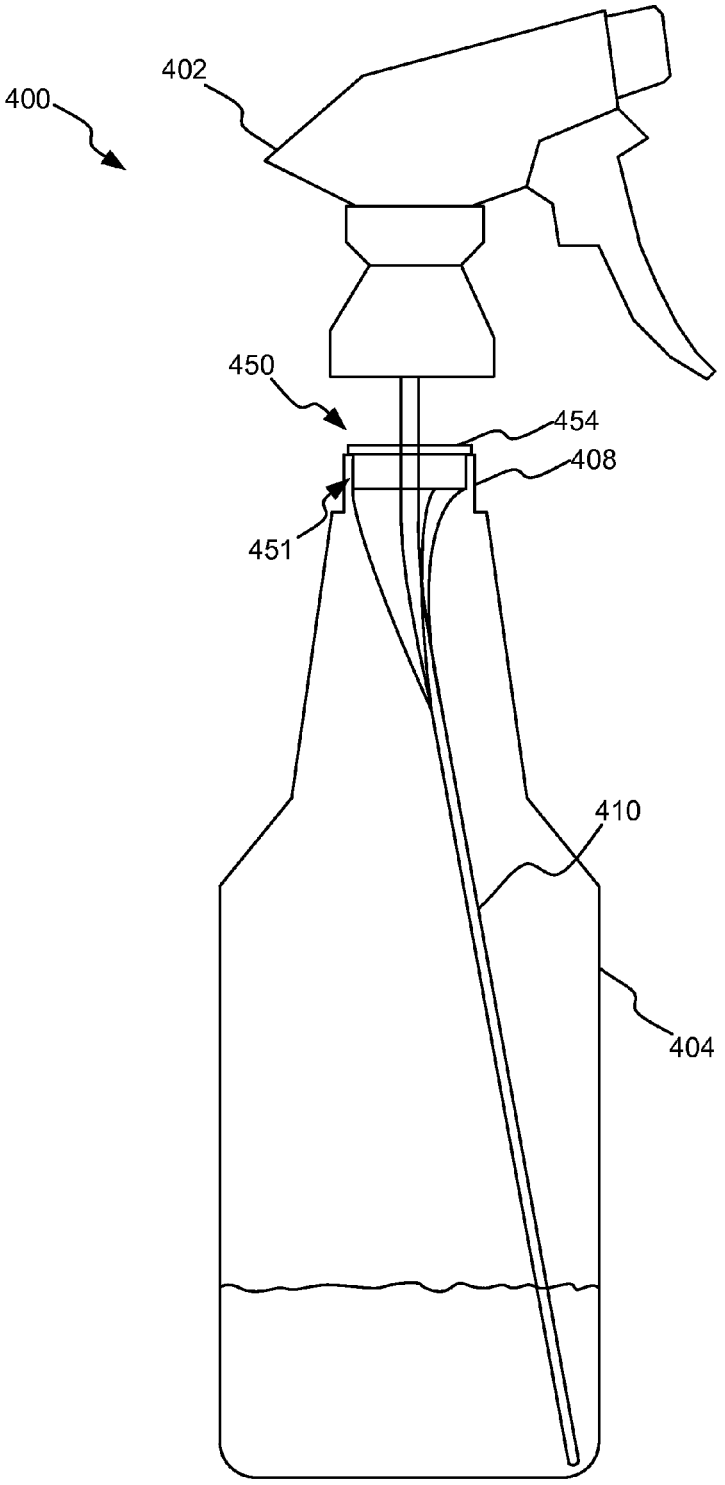
FIG. 4 illustrates another configuration of an insert used in combination with a traditional spray dispenser.

FIG. 4 illustrates another configuration of an insert 450 used in combination with a traditional spray dispenser 400. The insert 450 is illustrated as fitting substantially flush within a neck 408 of a body 404 of the spray dispenser 400 with a cap 402 ready to be coupled to the neck 408. The coupling portion 451 of the insert 450 can be configured to couple to the neck 408 of the body 404 or to the cap 402, or to both. As illustrated, the coupling portion 451 can either be coupled to the neck 408 or just resting on the neck 408 by way of the flange 454.

Figure 5:
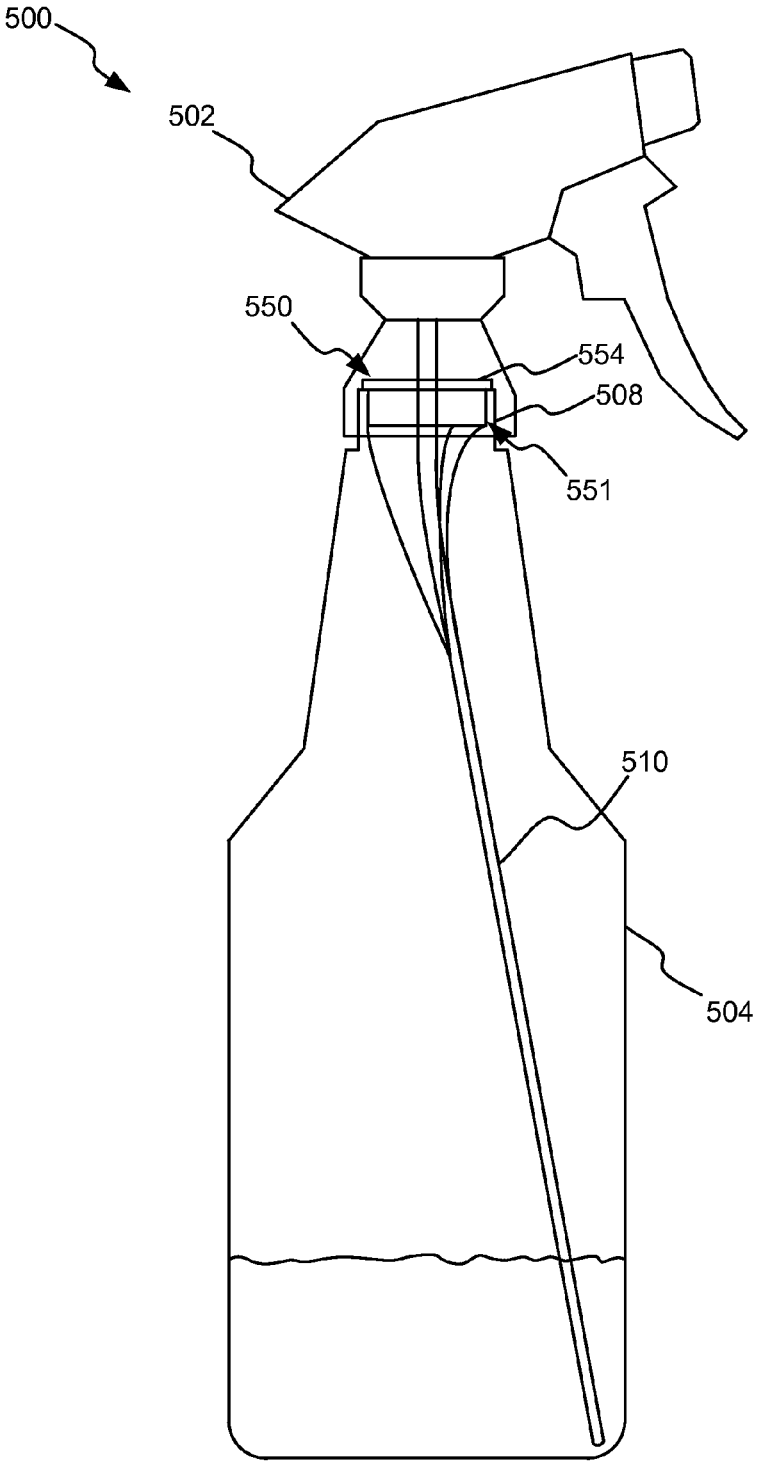
FIG. 5 illustrates yet another configuration of an insert used in combination with a traditional spray dispenser.

FIG. 5 illustrates yet another configuration of an insert 550 used in combination with a traditional spray dispenser 500. In the illustrated configuration, the cap 502 and the body 504 are coupled to each other, and an insert 550 is arranged between them so as to deflect a direction of a flexible suction tube 510.

In one embodiment, the coupling portion 551 couples to the neck 508 via threads that allow the coupling portion 551 to be rotated and thus tighten the coupling portion 551 to the neck 508. In another embodiment, the coupling portion 551 couples to the cap 502 via threads that allow the coupling portion 551 to be rotated and thus tighten the coupling portion 551 to the cap 502. In yet another embodiment, the coupling portion 551 can have a snap connection to either the cap 502, the neck 508, or both. In yet other embodiments, the coupling portion 551 can couple to the cap 502 or the neck 508, or both, via a friction fit or an adhesive (e.g., an adhesive that can be dissolved in or by a non-aqueous solvent to facilitate removal from the dispenser 500). In some embodiments, the coupling portion 551 can include a gasket to preclude liquid from escaping the neck 508.

In other embodiments, the coupling portion 551 can be coupled to the flexible suction tube 510. In one embodiment, the coupling portion 551 couples to the cap 502, the neck 508, or both via the flange 554. The flange 554 can rest atop the neck 508. Alternatively, the flange 554 can be pressed between a portion of the cap 502 and a top of the neck 508 (e.g., see 754, 702, and 708 in FIG. 7). In one embodiment, the flange 554 can be a gasket or at least partially made from a flexible substance such as rubber.

Figure 6:
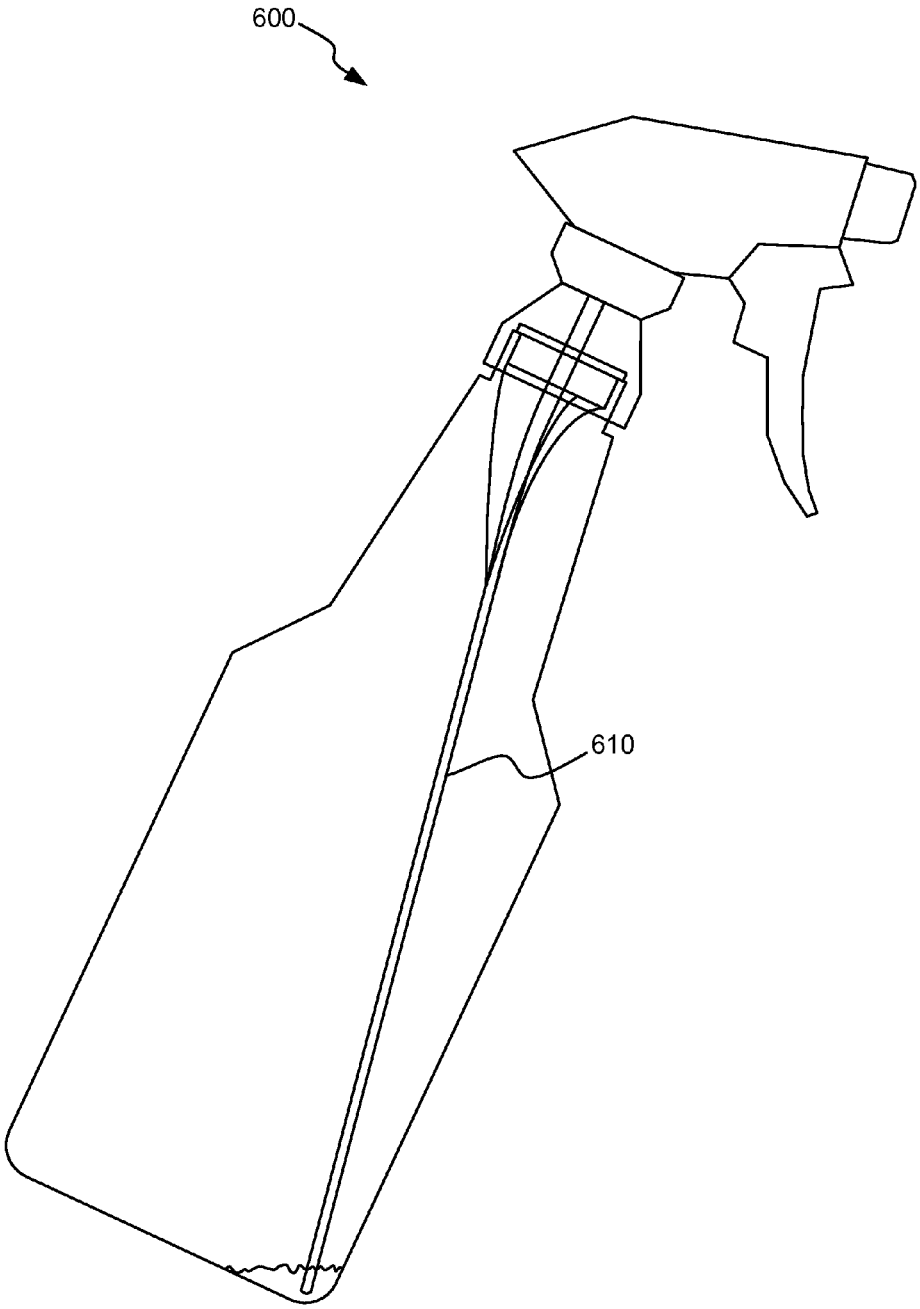
FIG. 6 illustrates the configuration of FIG. 5 with the spray dispenser tipped at an angle.

FIG. 6 illustrates the configuration of FIG. 5 with the spray dispenser 600 tipped at an angle. This illustrates how the flexible suction tube 610 can access a small amount of liquid in a bottom corner (or rim) of the spray dispenser 600, especially when the dispenser 600 is tilted so that the liquid congregates in the corner.

Returning to FIG. 2, the flange 254 can have a thickness (height) of between 0.5 mm and 3.0 mm, or between 1.0 and 2.0 mm. Since the flange 254 may be pressed between a portion of the cap and a top of the neck (see, for instance, FIGS. 5-7), the flange 254 may reduce the number of rotations that the cap can make when screwed onto the neck (assuming that coupling between the two is via interlocking threads). Thus, the thinner the thickness or height of the flange 254 the tighter the cap can be coupled to the body of the spray dispenser.

The coupling portion 251 includes a midsection 252 coupled between the flange 254 and the guide portion 260. The midsection 252 can rest within the neck 108 and maintain a substantially flush coupling to an inner diameter of the neck 108. As such, and more so as the height 256 increases, the midsection 252 prevents pivoting of the coupling portion 251 relative to the vertical axis 274. In particular, the midsection 252 is coaxially arranged relative to the vertical axis 274 of the dispenser 100, and the midsection 252 helps maintain this coaxial configuration despite torque (and thus a desire to pivot) from the flexible suction tube 210 that might otherwise cause the coupling portion 250 to pivot relative to the axis 274. This helps to maintain a consistent deflection angle 272 of the flexible suction tube 210.

The midsection 252 has an exemplary thickness (height) 256 that includes, but is not limited to, between 8-20 mm, or 18-20 mm. In a particular embodiment, the midsection 252 can have a height 256 of 7-10 mm or 9 mm. In another embodiment, the midsection 252 can have a height of 5-20 mm.

The mouth 258 can be coaxially aligned with the vertical axis 274. The mouth 258 can have any radius that is large enough to allow the flexible suction tube 210 to pass through the mouth 258.

The guide portion 260 can be shaped so as to receive an end of the flexible suction tube 210 and to deflect the flexible suction tube 210 at an angle 272 that the flexible suction tube 210 makes with the axis 274. This deflection angle 272 enables the flexible suction tube 210 to be directed to an off-center portion of the bottom of the body (e.g., see FIGS. 4-6). The deflection angle 272 can be tailored to different dispenser shapes and dimensions. By selecting a particular deflection angle 272, the insert 250 can be designed to guide the flexible suction tube 210 into a corner of the dispenser where the hardest-to-reach remnants of liquid often reside. As such, the insert 250 enables more of the liquid in the dispenser to be used than is possible via traditional spray dispensers. Exemplary deflection angles 272 include those greater than 21°, those greater than 22°, those greater than 23°, those greater than 24°, those greater than 25°, and those greater than 26°. However, other deflection angles 272 are also envisioned (e.g., any deflection angle greater than 0°.

What is more, the insert 250 can be used both in manufacturing new dispensers, or as an aftermarket product that can be used in combination with traditional dispensers not designed to handle the problem of liquid remnants in the corners of a spray dispenser. In other words, purchasers of traditional bottles can retrofit such dispensers with a separately-purchased insert 250 in order to direct the flexible suction tube towards a bottom corner of the dispenser.

Although the guide portion 260 is illustrated as being tapered, this shape is not limiting and numerous other shapes can also be utilized (e.g., cylindrical). Ribs or other structures may be built into the guide portion 260 to enhance structural rigidity or cut weight or cost of materials as will be well-known to one of skill in the art of injection molding.

In some embodiments, the insert 250 can be between 1-4" in length, as measured from a top of the flange 254 to a bottom of the guide portion 260.

Figure 7:
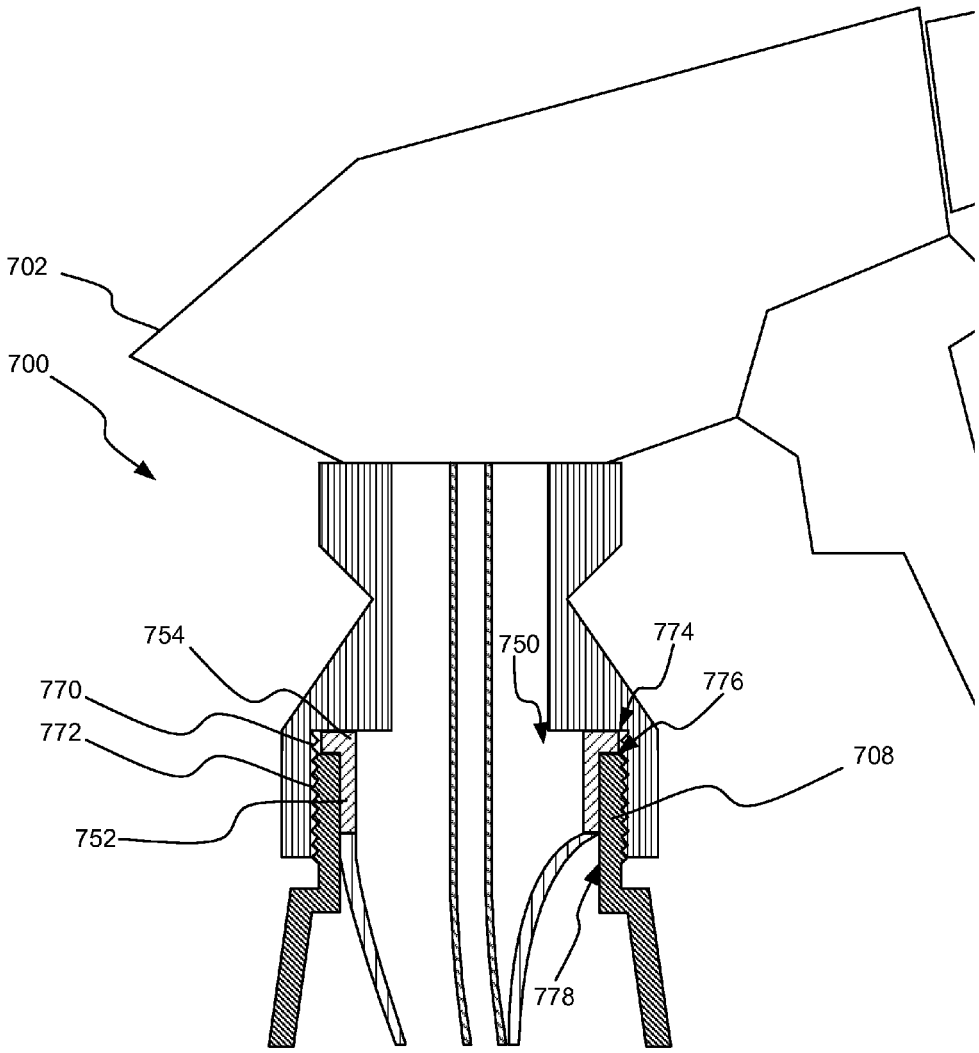
FIG. 7 illustrates a cross section of a spray dispenser.

FIG. 7 illustrates a cross section of a spray dispenser 700. As seen, the cap 702 can have threads 770 on an inner surface that engage with outer threads 772 of the neck 708 when the cap 702 and neck 708 are rotated in opposite directions. As the cap 702 is rotated or screwed onto the neck 708, the insert 750 becomes wedged between the two. In particular, the flange 754 can be wedged or pressed between a downward-facing surface 774 of the cap 702 and an upward-facing (or top) surface 776 of the neck 708. This pressure prevents the insert 750 from moving vertically. The midsection 752 of the insert 750 rests flush or at least parallel with the inner surface 778 of the neck 708. Because of the height of the midsection 752, the insert 750 is precluded from pivoting relative to a vertical axis (not illustrated, but see FIG. 2). The flange 754 may also aid in preventing such pivoting.

As illustrated, the height of the flange 754 prevents all of the inner threads 770 of the cap 702 from engaging all of the outer threads 772 of the neck 708. Thus, reducing the height of the flange 754 can improve the seal between the threads as well as the coupling between the cap 702 and the neck 708.

While the present disclosure often references the flange 254, 454, 554, 754, such a flange is not required. In some embodiments, the insert 250, 350, 450, 550, 750 can be coupled to the neck 308, 408, 508, 708 or the cap 302, 402, 502, 702 of the bottle 300, 400, 500, 600, 700 via other means such as friction fits or snap-connections.

Figure 8:
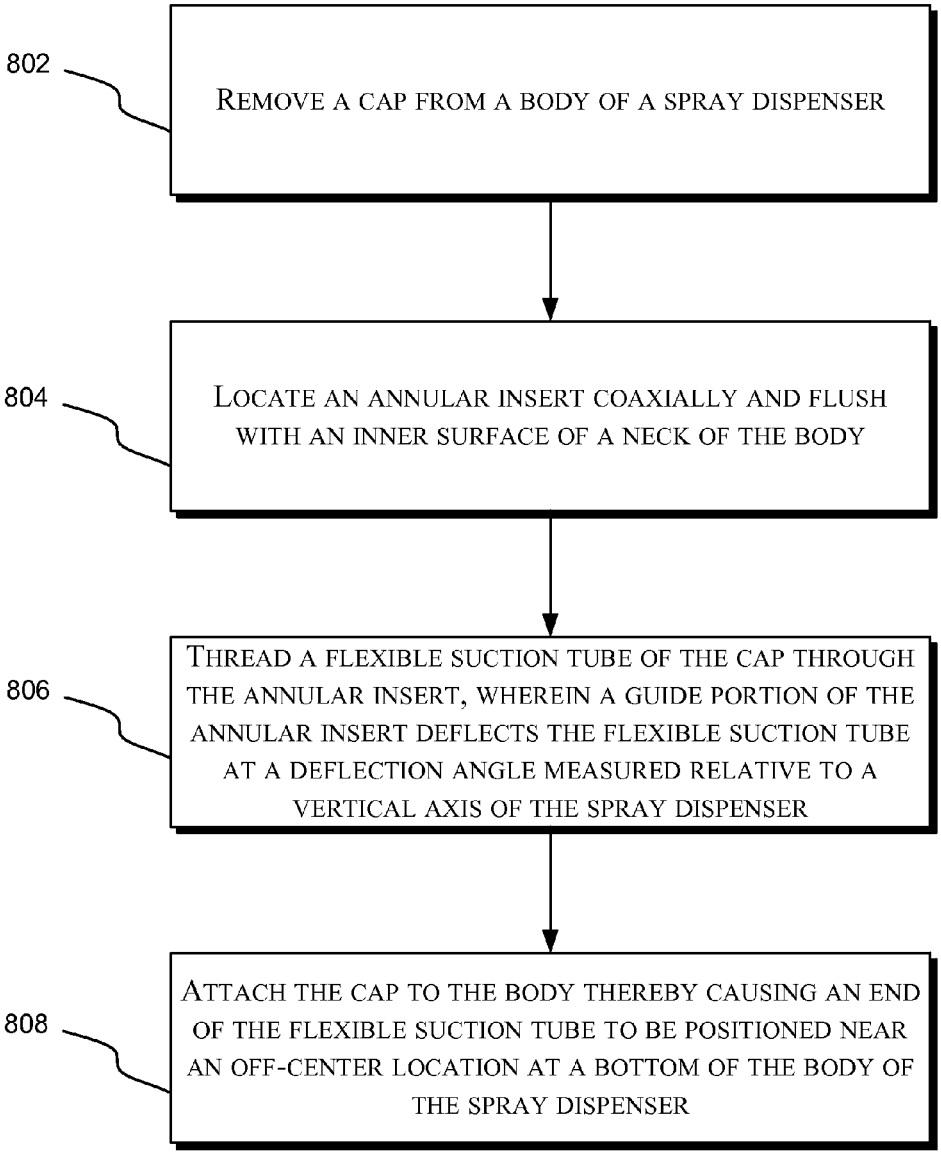
FIG. 8 illustrates a method of using the insert herein described.

FIG. 8 illustrates a method of using the insert herein described. In order to use the insert (e.g., 200) a spray dispenser (e.g., 100) can first be opened, for instance by removing the cap (e.g., 102) from the body (e.g., 104). This can be done via a remove cap operation 802.

The insert, which can be annular, can then be placed inside and substantially flush with an inner surface of a neck (e.g., 108) of the body of the spray dispenser. The insert may be coaxially arranged relative to a vertical axis (e.g., 274) of the spray dispenser. This can be done via a locate insert operation 804.

A flexible suction tube (e.g., 110) of the cap can be threaded through the insert until an end (e.g., 112) of the flexible suction tube contacts an inner surface of a guide portion (e.g., 260) of the insert. Continued threading will cause the flexible suction tube to be deflected by the guide portion at a deflection angle (e.g., 272) relative to the vertical axis. This threading can be done via a thread tube operation 806.

Lastly, the cap is attached to the neck (for instance via rotation of both components in opposite directions so as to engage inner threads (e.g., 770) of the cap with outer threads (e.g., 772) of the neck). As this attachment takes place, the guide portion will cause the flexible suction tube to come to be positioned near an off-center location at a bottom of the body of the spray dispenser (e.g., the position illustrated in FIGS. 4-6). This can be accomplished in an attach cap operation 808.

Recalling FIGS. 1 and 2, in some embodiments, a diameter of the midsection 252 may be fabricated for different diameter necks 108. For instance, one midsection 252 can have a diameter of 19 mm, while another has a diameter of 20 or 21 mm, and another has a diameter of 22 mm. However, in one embodiment, the midsection 252 includes an upper and lower portion, where the lower portion is offset from the upper portion, thereby effectively allowing the midsection 252 to have two different diameters (see FIGS. 9 and 10).

Figure 9:
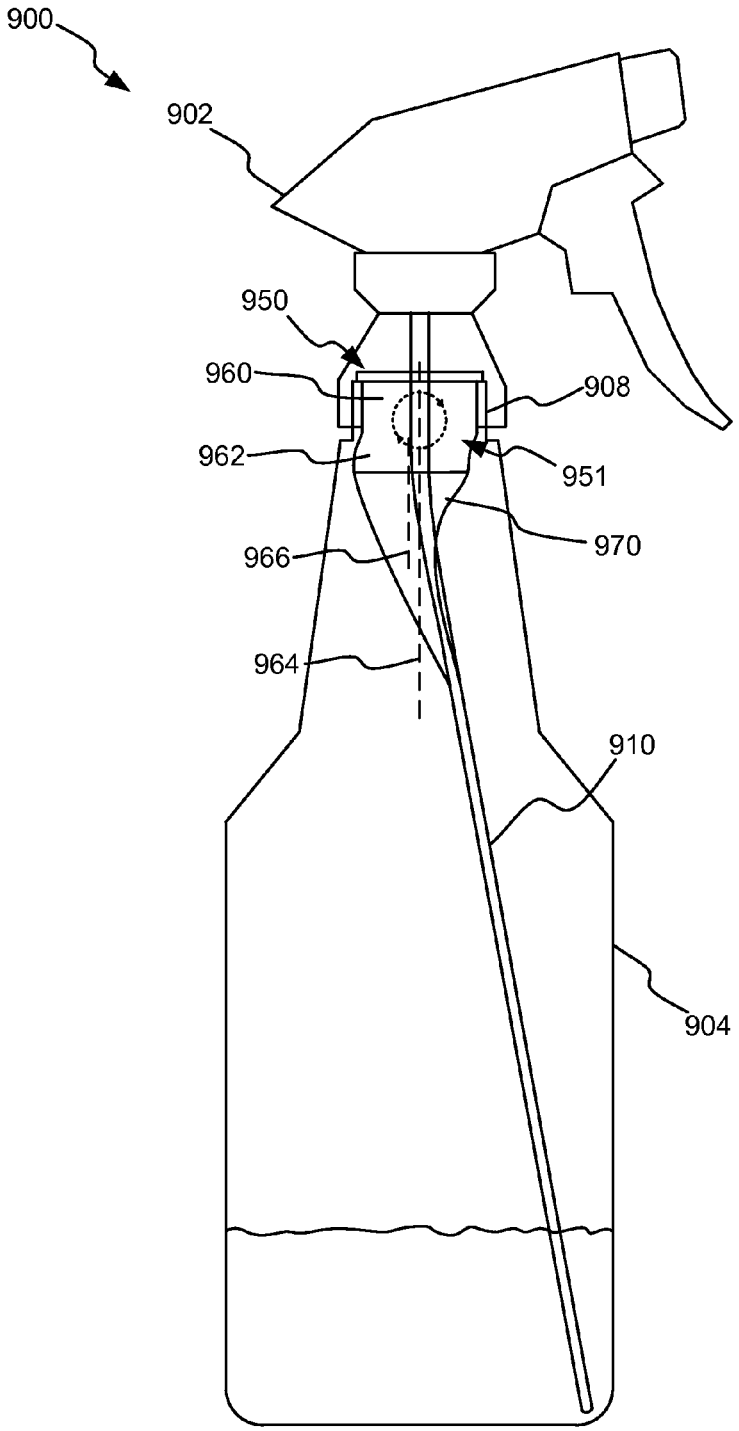
FIG. 9 illustrates another configuration of an insert 950 used in combination with a traditional spray dispenser 900

FIG. 9 illustrates another configuration of an insert 950 used in combination with a traditional spray dispenser 900. In the illustrated configuration, the cap 902 and the body 904 are coupled to each other, and an insert 950 is arranged between them so as to deflect a direction of a flexible suction tube 910. The coupling portion 951 includes an upper portion 960 and a lower portion 962. The upper portion can have a diameter that is substantially equal to a diameter of the lower portion 962. When the insert 950 is pushed into the neck 908, a guide portion 970 passes through the neck 908 first, followed by the lower portion 962, and then the upper portion 960. Since the lower portion 962 has substantially the same diameter as the upper portion 960, both portions are able to slide through the neck 908 with nominal impedance.

A vertical axis 964 exists at a center of the neck 908, the cap 902, and the upper portion 960 of the insert 950. The lower portion 962 can be offset from the upper portion 960, which also means that the lower portion 962 is offset from the vertical axis 964. The offset can be in a direction opposite to a direction that the flexible suction tube 910 is deflected.

As illustrated, the flexible suction tube 910 is deflected towards a front of the spray dispenser 900 (to the right of the page). This generates a rotational force on the insert 950 as indicated by the dotted circular arrows, which rotate around a horizontal axis. The lower portion 962 of the midsection 951 is offset towards a back of the spray dispenser 900 (to the left of the page). In other words, the upper portion 960 is concentrically arranged with the neck 908 and the cap 902 (flush with an inside of the neck 908), while the lower portion 962 is not concentrically arranged with the neck 908 and the cap 902. The lower portion 962 is arranged below the neck 908.

The upper portion 960 also has a height and the lower portion 962 has a height. These two heights can be the same or different. The upper portion 960 can have a range of heights including, but not limited to, 12-20 mm, and the lower portion 960 can have a range of heights including, but not limited to, 1-9 mm.

As viewed in profile (see FIG. 9), the upper portion 960 has a cylindrical shape. The lower portion 962, while illustrated with a profile that is bent or curved (like a slinky), can also be cylindrical (having a profile where outer edges are parallel vertical lines). The upper portion 960 can also be non-cylindrical in some embodiments. The upper and lower portions 960, 962 can be connected via tapered or curved profile as illustrated. However, in other embodiments, the upper and lower portions 960, 962 can be connected via an angled profile. The taper or curvature between the upper and lower portions 960, 962 can make it easier to slide the insert 950 into the neck 908.

The curvature of the lower portion 962 can smoothly transition into a profile of a guide portion 970 as it descends into the bottle 904. Although the upper portion 960, lower portion 962, and guide portion 970 have been described separately, in some embodiments, the three portions can be a single component and/or can be made from a single material or in a single cast or a single manufacturing process.

Figure 10:
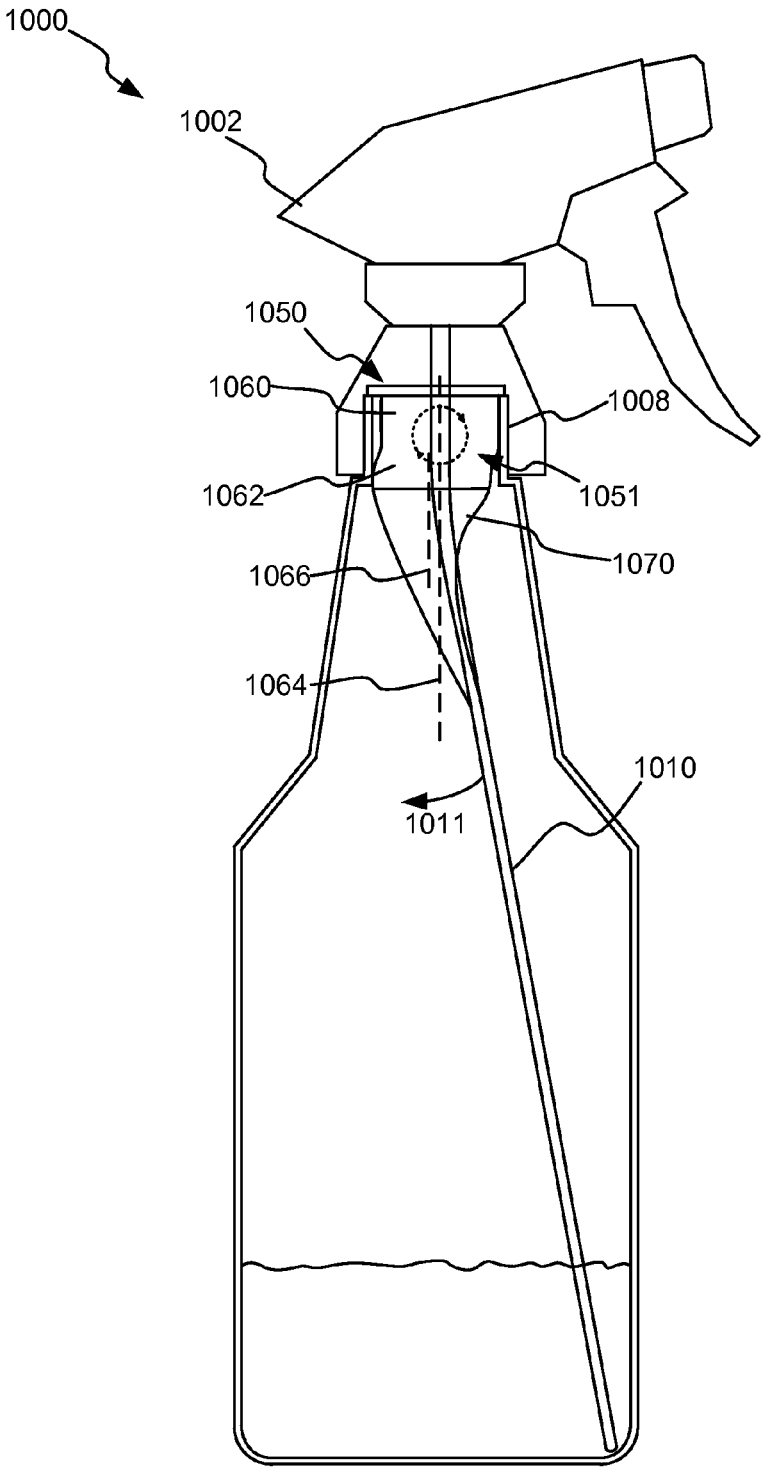
FIG. 10 illustrates the insert of FIG. 9 as used in a spray dispenser having a wider neck diameter than that illustrated in FIG. 9

The purpose of the upper and lower portions 960, 962 is to allow a single insert 950 to operate in spray dispensers 900 having different diameter necks 908. FIG. 9 illustrates the insert 950 as arranged in a spray dispenser 900 having a smaller neck 908 diameter. For instance, the neck 908 diameter could be 20 mm. The insert 950 can also be used, however, in a neck 908 having a larger diameter, such as 22 mm (as illustrated in FIG. 10). Regardless of the diameter of the neck 950, the upper and lower portions 960, 962 prevent rotation of the insert 950 in a direction as indicated by the dotted circular arrows. The rotation as indicated by the dotted circular arrows can also be described as rotating around an axis that is horizontal.

FIG. 10 illustrates the insert of FIG. 9 as used in a spray dispenser having a wider neck diameter than that illustrated in FIG. 9. The insert 1050 again includes an upper portion 1060 and a lower portion 1062. However, in this case a diameter of the neck 1008 is wider than a diameter of the upper portion 1060. Despite the diameter of the neck 1008 being wider than the diameter of the upper portion 1060, the offset between the upper and lower portions 1060, 1062, along with a torque 1011 on the insert 1050 (generated by the flexible suction tube 1010 pressing against the guide portion 1070), forces a front of the upper portion 1060 to press against a front of the inside of the neck 1008 (towards page right) while the lower portion 1062 is forced against an inside back of the neck 1008 (towards page left). The direction of this torque is also indicated by the dotted circular arrows overlaid in the center of the midsection 1051.

A distance between a back of the lower portion 1062 and a front of the upper portion 1060 can be equal to or slightly narrower than the diameter of the neck 1008. In other words, this distance is sufficient to ensure that the insert 1050 is unable to rotate in the direction indicated by the dotted circular arrows.

As seen, the insert 950, 1050 illustrated in FIGS. 9 and 10 can be used in spray dispensers 900, 1000 having different diameter necks 908, 1008, while still preventing rotation of the insert 950, 1050 in a direction as indicated by the dotted circular arrows in FIG. 10.

It will be understood by one of skill in the art that the locate insert operation 804 and thread tube operation 806 are interchangeable in order and can be carried out in an overlapping or simultaneous manner as well as at separate times. For instance, the flexible suction tube can be threaded through the insert while the insert is being located flush within the neck. As another example, the flexible suction tube can first be threaded through the insert before the insert is located within the neck.

In conclusion, the present invention provides, among other things, a method, system, and apparatus for increasing the amount of liquid that can be removed via a flexible suction tube from a bottom of a spray dispenser. Those skilled in the art can readily recognize that numerous variations and substitutions may be made in the invention, its use, and its configuration to achieve substantially the same results as achieved by the embodiments described herein. Accordingly, there is no intention to limit the invention to the disclosed exemplary forms. Many variations, modifications, and alternative constructions fall within the scope and spirit of the disclosed invention.

What is claimed is:

1. A bottle insert comprising:

a coupling portion configured to couple to a cap or neck of a first spray dispenser, the neck of the first spray dispenser having a first circumference, the coupling portion further preventing substantial movement of the apparatus relative to the spray dispenser, and further configured to couple to a cap or neck of a second spray dispenser, the neck of the second spray dispenser having a second circumference larger than the first circumference; and a guide portion coupled to a bottom of the coupling portion and configured to descend into a body of the first or second spray dispenser, the guide portion shaped so as to deflect, at an angle, a flexible suction tube of the cap towards an off-center portion of a bottom of the body of the first or second spray dispenser;

wherein the coupling portion includes a flange and a midsection, and wherein a lower portion of the midsection is shifted, relative to an upper portion of the midsection, in a direction opposite to a direction in which the flexible suction tube is deflected; and wherein the upper and lower portions of the midsection are non-coaxial and substantially equal in diameter such that:

a circumference of the upper portion is configured to be coaxial and flush with an inner surface of the neck of the first spray dispenser, and only a portion of the circumference of the upper portion and only a portion of a circumference of the lower portion is flush with the inner surface of the neck of the second spray dispenser.

2. The apparatus of claim 1, wherein the coupling portion is annular.

3. The apparatus of claim 1, wherein the flange is coupled to a top of the coupling portion.

4. The apparatus of claim 3, wherein the midsection is coupled to a top of the guide portion.

5. The apparatus of claim 4, wherein the flange is annular and extends radially outward from a center of the coupling portion.

6. The apparatus of claim 5, wherein the flange is configured to prevent vertical movement of the apparatus.

7. The apparatus of claim 6, wherein the flange is configured to be squeezed between a portion of the cap and a top of the neck of the first or second spray dispenser.

8. The apparatus of claim 4, wherein the midsection is configured to be arranged substantially flush with the inner surface of the neck of the first or second spray dispenser so that the apparatus is substantially unable to pivot.

9. The apparatus of claim 1, wherein the angle is greater than 21°.

10. The apparatus of claim 9, wherein the angle is greater than 22°.

11. The apparatus of claim 10, wherein the angle is greater than 25°.

12. The apparatus of claim 1, wherein the midsection is annular, and the midsection is configured to be coaxially arranged relative to a vertical axis of the first or second spray dispenser.

13. A method comprising:

removing a cap from a body of a first or second spray dispenser;

locating an annular insert within a neck of the body, the neck having a first circumference when the neck is of the first spray dispenser, and the neck having a second circumference when the neck is of the second spray dispenser, the second circumference being greater than the second circumference, wherein the annular insert comprises a midsection having an upper and a lower portion, the upper and lower portions being non-coaxial and substantially equal in diameter such that:

a circumference of the upper portion is configured to be coaxial and flush with the inner surface of the neck of the first spray dispenser, and only a portion of the circumference of the upper portion and only a portion of a circumference of the lower portion are configured to be flush with the inner surface of the neck of the second spray dispenser;

threading a flexible suction tube of the cap through the annular insert, wherein a guide portion of the annular insert deflects the flexible suction tube at a deflection angle measured relative to a vertical axis of the first or second spray dispenser, whichever spray dispenser the annular insert is located within; and attaching the cap to the body thereby causing an end of the flexible suction tube to be positioned near an off-center location at a bottom of the body of the first or second spray dispenser, whichever spray dispenser the annular insert is located within.

14. The method of claim 13, wherein the deflection angle is designed to match different spray dispenser shapes and dimensions.

15. The method of claim 14, wherein the deflection angle is at least 21°.

16. An insert comprising:

a coupling portion comprising:

a midsection configured to couple to a cap and/or neck of a first spray dispenser, the neck of the first spray dispenser having a first circumference, the midsection further configured to prevent substantial pivoting of the apparatus relative to the spray dispenser, the midsection further configured to couple to a cap and/or neck of a second spray dispenser, the neck of the second spray dispenser having a second circumference larger than the first circumference;

a flange extending radially from a top of the midsection and configured to couple to the cap and/or neck of the first or second spray dispenser, the flange further preventing substantial vertical movement of the apparatus relative to the first or second spray dispenser; and a guide portion coupled to a bottom of the midsection and configured to descend into a body of the first or second spray dispenser, the guide portion shaped so as to deflect, at an angle, a flexible suction tube of the cap towards an off-center portion of a bottom of the body of the first or second spray dispenser; and wherein the midsection has an upper and a lower portion, the upper and lower portions being non-coaxial and substantially equal in diameter such that:

a circumference of the upper portion is configured to be coaxial and flush with the inner surface of the neck of the first spray dispenser, and only a portion of the circumference of the upper portion and only a portion of a circumference of the lower portion are configured to be flush with the inner surface of the neck of the second spray dispenser.

* * * * *